US006851928B2

(12) United States Patent
Tam et al.

(10) Patent No.: US 6,851,928 B2
(45) Date of Patent: Feb. 8, 2005

(54) BLOWER MOTOR

(75) Inventors: Siu Chun Tam, Hong Kong (CN); Kwong Yip Poon, Hong Kong (CN)

(73) Assignee: Johnson Electric S.A., La Chaux-de-Fonds (CH)

( * ) Notice: Subject to any disclaimer, the term of this patent is extended or adjusted under 35 U.S.C. 154(b) by 35 days.

(21) Appl. No.: 10/355,113

(22) Filed: Jan. 31, 2003

(65) Prior Publication Data

US 2003/0147747 A1 Aug. 7, 2003

(30) Foreign Application Priority Data

Feb. 7, 2002 (GB) ..... 0202835

(51) Int. Cl.[7] ..... F01D 1/02
(52) U.S. Cl. ..... 415/211.2; 415/186 R; 416/203
(58) Field of Search ..... 415/211.2, 208.2, 415/186 R, 234, 241 R, 97 R, 97 A, 96 R, 96 A

(56) References Cited

U.S. PATENT DOCUMENTS

| | | | | |
|---|---|---|---|---|
| 3,263,909 | A | 8/1966 | Mazepa | |
| 4,767,285 | A | 8/1988 | Jyoraku | |
| 5,394,041 | A | 2/1995 | Oberdorfer-Bögel | |
| 6,166,462 | A | 12/2000 | Finkenbinder et al. | |
| 6,179,561 | B1 * | 1/2001 | Horng | 415/208.3 |

FOREIGN PATENT DOCUMENTS

| | | |
|---|---|---|
| EP | 1 025 792 A2 | 8/2000 |
| EP | 1 048 258 A2 | 11/2000 |

* cited by examiner

*Primary Examiner*—Edward K. Look
*Assistant Examiner*—James M. McAleenan
(74) *Attorney, Agent, or Firm*—Birch, Stewart, Kolasch & Birch, LLP

(57) ABSTRACT

A diffuser plate 22 for a bypass blower motor assembly has a number of vanes 34 for guiding air flow from an impeller to outlet openings in an impeller housing. Each vane has two curved air guiding blades 36, 37. One blade 36 guides the air axially and circumferentially from the impeller towards the outlet openings and the other blade 37 guides the air radially through the outlet openings.

6 Claims, 3 Drawing Sheets

BLOWER MOTOR

CROSS-REFERENCE TO RELATED APPLICATIONS

This application claims convention priority from GB 0202835.5 filed Feb. 7, 2002.

BACKGROUND OF THE INVENTION

1. Field of the Invention

This invention relates to blower motors and in particular, to a blower motor for use in a bypass or wet-type vacuum cleaner application.

3. Background Art

Blower motors in bypass vacuum cleaners have an impeller which moves air from an inlet to an outlet of an impeller housing fitted to the motor without passing through the motor itself. This construction allows the vacuum cleaner to suck up liquids as well as dust and dirt without damaging the electric motor.

The impeller is mounted on a shaft of the motor. The shaft is journalled in a bearing where it passes through an end bracket of the motor housing which also acts as a divider between the motor and the impeller. A diffuser plate sits on the end bracket within the impeller chamber to direct air from the impeller towards the outlets. Generally such diffusers guide the air circumferentially and/or axially relying on the air pressure build-up within the impeller chamber to force the air out through the openings this produces a bottleneck in the airflow path and appears to be a major source of noise and inefficiency in the operation of the blower.

SUMMARY OF THE INVENTION

The present invention seeks to overcome this problem by directing the air towards and through the outlet openings in the impeller housing. This is achieved by providing a diffuser plate with a number of vanes with two blades for directing the air axially and radially.

Accordingly, the present invention provides a blower motor assembly comprising: a motor including a shaft and a fan end bracket supporting a bearing for the shaft; a diffuser plate fitted to the fan end bracket; an impeller fixed to the shaft for rotation therewith; and an impeller housing having an inlet opening and a plurality of outlet openings wherein the impeller is axially located between the inlet and outlet openings for moving air therebetween and the diffuser plate has a plurality of peripheral vanes arranged to direct air from the impeller to the outlet openings, and wherein the vanes direct the air axially away from the impeller, circumferentially to align with respective outlet openings and radially through the openings.

Addition and/or preferred features are set out in the dependent claims.

BRIEF DESCRIPTION OF THE DRAWINGS

A preferred embodiment of the present invention will now be described, by way of example only, with reference to the accompanying drawings, in which.

DETAILED DESCRIPTION OF THE PREFERRED EMBODIMENT

Figure 1:
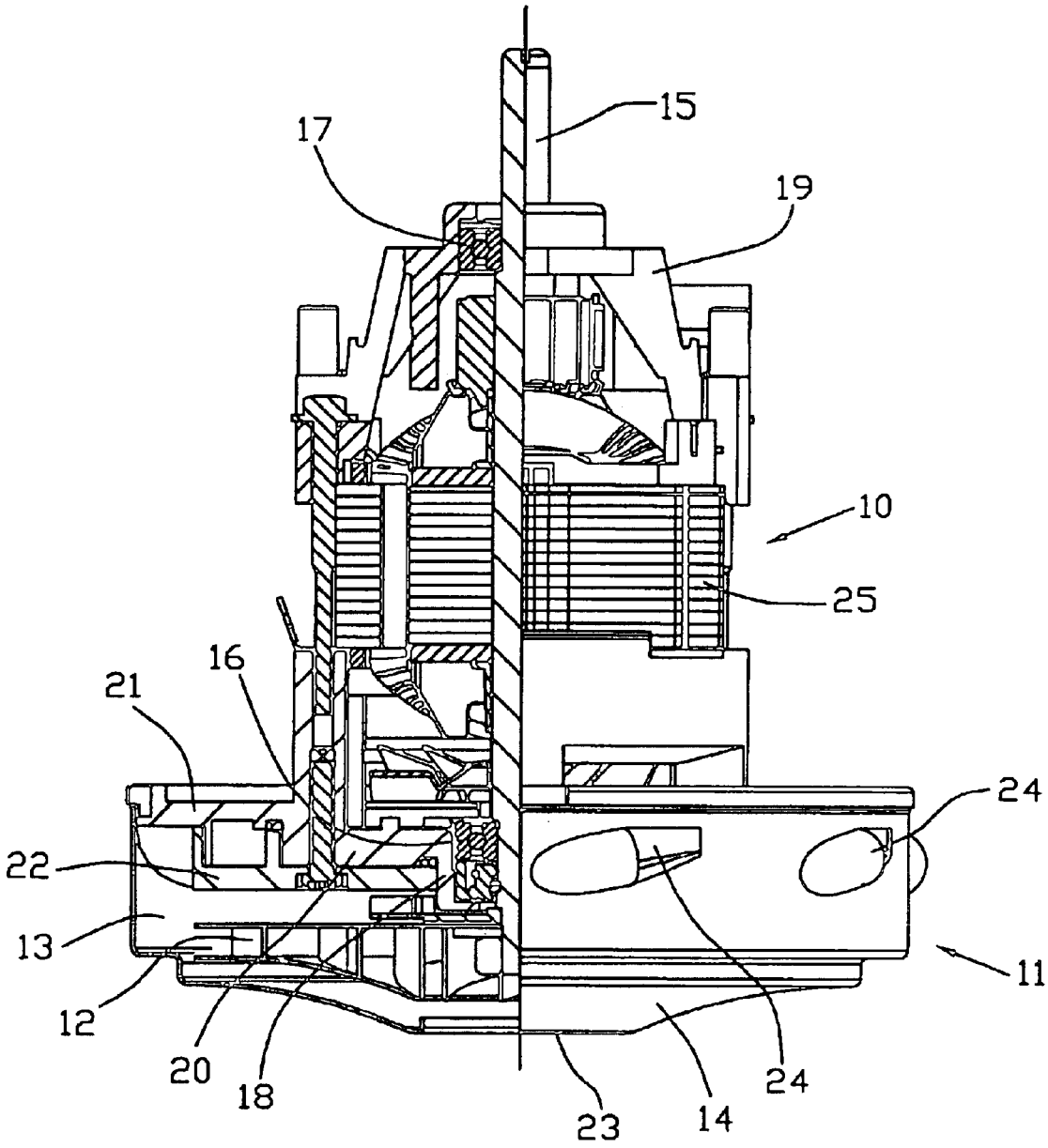
FIG. 1 is a part sectional view of a bypass blower motor assembly incorporating a diffuser plate according to the present invention.
Figure 2:
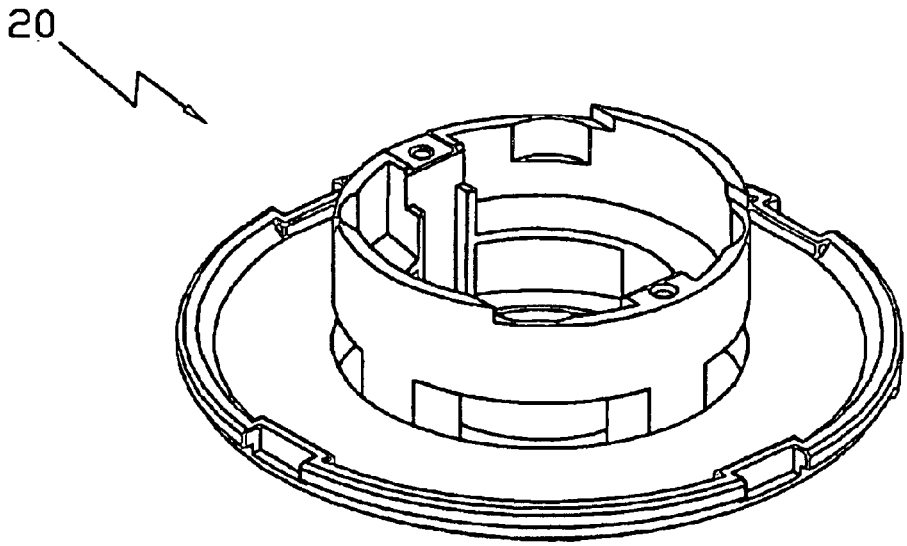
FIG. 2 is perspective view from above of a fan end bracket used in the assembly of FIG. 1.
Figure 3:
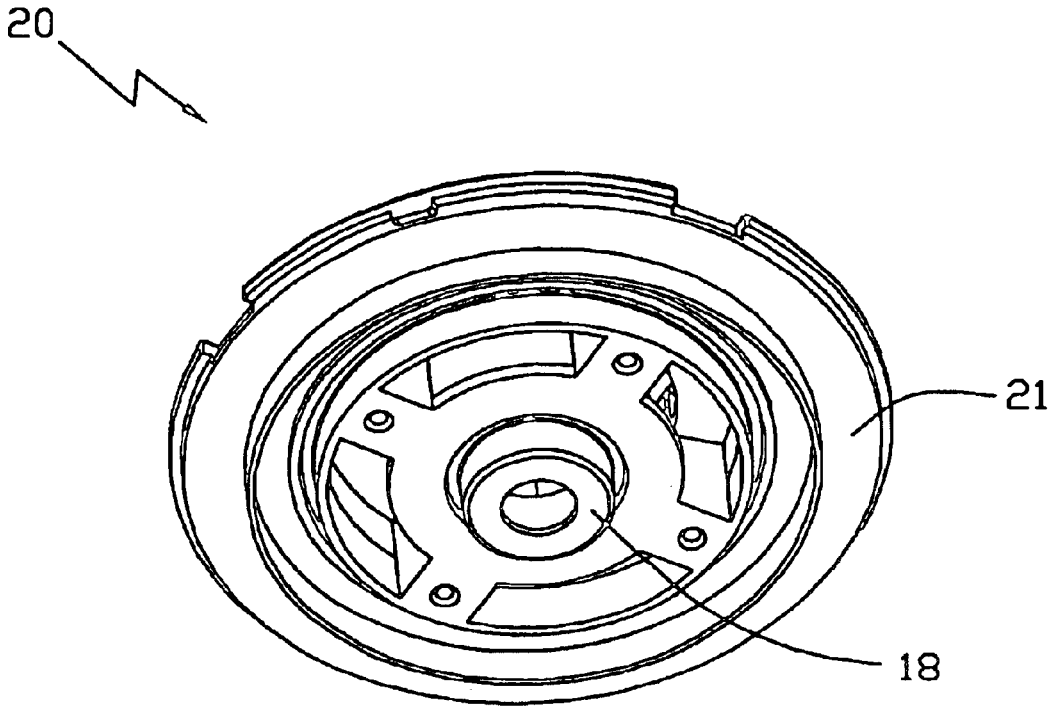
FIG. 3 is a perspective view from below of the bracket of FIG. 2.

FIG. 1 shows a bypass blower motor assembly in partial section. The assembly has a motor section 10 and a blower section 11. The motor section comprises a universal motor. Operation of the motor is well known and will not be described.

The blower section 11 comprises an impeller 12 of the centrifugal fan type located inside an impeller chamber 13 defined by a drawn cup-shaped impeller housing 14 having a lower wall and a peripheral wall and coupled to a flange 21 of a fan end bracket 20 of the motor The fan end bracket 20 separates the blower section 11 from the motor section 10 and closes the open end of the impeller housing 14. The impeller housing 14 has a single central inlet 23 in its lower wall and a plurality of outlet openings 24 in its peripheral wall.

The universal motor has a shaft 15 mounted in bearings 16 and 17. Bearing 16 is fitted to a boss 18 in the fan end bracket 20 while bearing 17 is fitted to an input bracket 19. A stator core 25 of the motor 10 is clamped between the two end brackets 19, 20.

By rotation, the impeller 12 draws air into the impeller chamber 13 through the inlet 23 and by centrifugal force compresses the air in the impeller chamber 13 thus forcing the air out the outlet openings 24. For a quieter operation, the outlet openings 24 are not axially aligned with the impeller 12 and are axially spaced. A diffuser plate 22 is used to guide the air flow from the impeller 12 to the outlet openings 24. The diffuser plate 22 has a central portion for attachment to the fan end bracket 20 including an axially extending peripheral skirt 33. The skirt 33 supports a number of vanes 34, one per outlet opening 24, for guiding the air from the impeller 12 towards and through the outlet openings 24. The vanes 34 have twin blades 36, 37. One blade 36 extends from one axial face of the diffuser plate 22 to the other curving around the peripheral skirt 33. Thus blade 36 guides the air both axially and circumferentially to align the air flow with the outlet openings. Blades 36 are also curved in the axial direction to gradually change the rate of axial movement. The other blade 37, extends tangentially from the skirt 33 and is curved radially to gently guide and urge the air flow radially towards and through the outlet opening 24.

Figure 4:
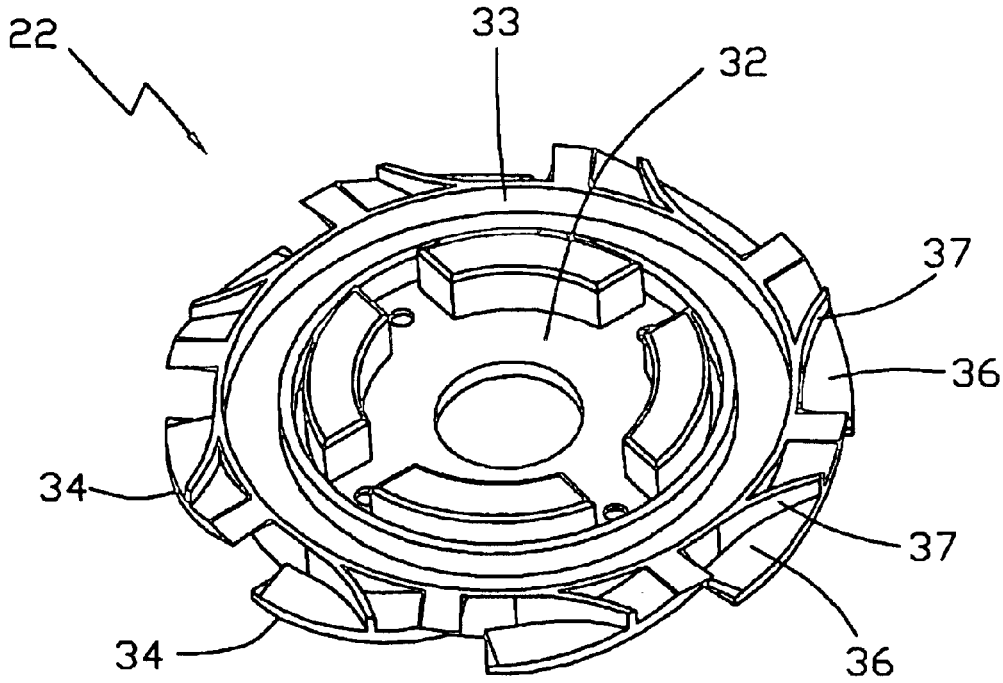
FIG. 4 is a perspective view from above of the diffuser plate of FIG. 1.
Figure 5:
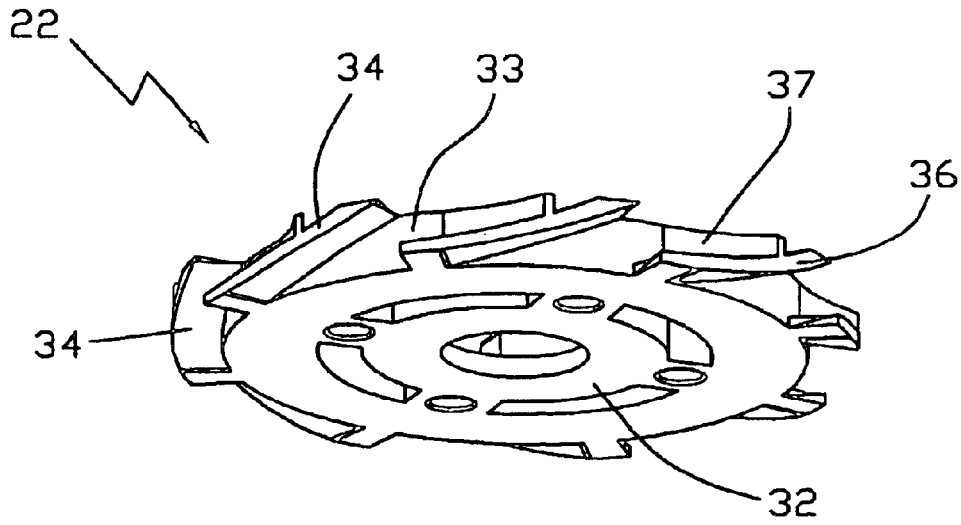
FIG. 5 is a perspective view from below of the diffuser plate of FIG. 4.

As can be seen in FIGS. 4 and 5, the blades 36 extend from one axial side of the diffuser plate to the other side and terminate flush with the planar surface of the confronting axial face of the fan end bracket 20.

The embodiment described above is given by way of example only and various modifications will be apparent to persons skilled in the art without departing from the scope of the invention as defined in the appended claims. For example, the fan end bracket flange could have an axially inclined surface, e.g., a conical surface to which the diffuser plate and vanes mate.

What is claimed is:

1. A bypass blower motor assembly comprising:

a motor including a shaft and a fan end bracket supporting a bearing for the shaft;

a diffuser plate fitted to the fan end bracket;

an impeller fixed to the shaft for rotation therewith; and an impeller housing having an inlet opening and a plurality of outlet openings, wherein the impeller is axially located between the inlet and outlet openings operable to create an air flow there-between and the diffuser plate has a plurality of peripheral vanes arranged to direct the air flow from the impeller to the outlet openings, and each vane has a first blade, which is curved in the axial direction to direct the air flow axially away from the impeller and circumferentially to align with respective outlet openings, and a second blade having a front surface and a rear surface extending from a periphery of the diffuser plate to direct the air flow radially outwardly through the outlet openings.

2. The bypass motor of claim 1 wherein the second blades smoothly extend from the periphery in the air flow direction.

3. The bypass motor of claim 1 wherein the vanes extend from one axial side of the diffuser plate adjacent the impeller to another opposite axial side of the diffuser plate adjacent the fan end bracket.

4. The bypass motor of claim 3 wherein the vanes terminate flush with the fan end bracket.

5. The bypass motor of claim 1 wherein the fan end bracket has a planar annular flange for attachment of the impeller housing and the vanes terminate flush with the planar surface of the flange.

6. The bypass motor of claim 1 wherein the end bracket has a radially extending annular flange for attachment of the impeller housing and an axial surface of the flange facing the impeller is axially inclined and the vanes of the diffuser plate terminate smoothly on said axial surface.

* * * * *